United States Patent [19]

Hatton et al.

[11] 4,356,084

[45] Oct. 26, 1982

[54] SELF-SEALING VALVE ASSEMBLY TO FACILITATE UNPLUGGING OF A CENTRIFUGAL CLEANER

[75] Inventors: Derald R. Hatton; David E. Chupka, both of Middletown, Ohio

[73] Assignee: The Black Clawson Company, Middletown, Ohio

[21] Appl. No.: 27,577

[22] Filed: Apr. 6, 1979

[51] Int. Cl.[3] ..... B04C 5/18; B04C 5/23

[52] U.S. Cl. ..... 209/211; 210/512.1; 134/167 R; 273/65 D

[58] Field of Search ..... 209/211; 210/512 R, 210/512 M; 137/240, 317, 223; 273/65 D; 134/167 R, 167 C, 166 R, 166 C

[56] References Cited

U.S. PATENT DOCUMENTS

| | | | |
|---|---|---|---|
| 2,349,463 | 5/1944 | Riddell | 273/65 D |
| 2,671,633 | 3/1954 | Corson | 273/65 D X |
| 2,731,028 | 1/1956 | McCord | 273/65 D |
| 3,940,331 | 2/1976 | Rastatter | 209/211 |
| 4,148,723 | 4/1979 | Mozley | 210/512 M X |

FOREIGN PATENT DOCUMENTS

| | | | |
|---|---|---|---|
| 354629 | 8/1931 | United Kingdom | 134/166 R |
| 1000860 | 8/1965 | United Kingdom | 134/167 R |

*Primary Examiner*—Ralph J. Hill

*Attorney, Agent, or Firm*—Biebel, French & Nauman

[57] ABSTRACT

A self-sealing element is provided in the outer wall of the discharge chamber of a centrifugal cleaning apparatus opposite the rejects discharge outlet. When a blockage occurs at the discharge outlet, a long needle-like nozzle is inserted through the sealing element to the blockage. Water or air under pressure is expelled from orifices in the nozzle and breaks up the blockage. After the nozzle is withdrawn, the sealing element, which may be formed of a silicone rubber, reseals itself.

10 Claims, 8 Drawing Figures

SELF-SEALING VALVE ASSEMBLY TO FACILITATE UNPLUGGING OF A CENTRIFUGAL CLEANER

BACKGROUND OF THE INVENTION

The present invention relates to apparatus for separating undesired particles from liquids and liquid suspensions, and, more particularly, to apparatus for the centrifugal separation of undesired particles from paper pulp stock.

Vortex chambers for separating solid particles from a liquid suspension are well-known. These chambers, commonly called hydrocyclones or liquid cyclones, are usually elongated, of circular cross-section, and may be either somewhat tapered or cylindrical as required. The suspension to be treated is introduced under pressure through a restricted tangential inlet, imparting a high velocity spiral flow to the suspension. A vortex is developed and extends from the inlet end of the chamber to its opposite end. Velocities are high enough that an axial gas core is formed at the center of the chamber. Larger and heavier particles are thrown outwardly against the sides of the chamber and migrate toward a rejects outlet at the end of the chamber opposite the inlet. Accepted stock is removed at the end opposite the rejects outlet.

Cyclones are commonly used to separate sand, grit, bark particles, and shives from cellulose fibers in a papermaking slurry. As the trend in the paper-making industry has been to utilize more of the tree, including branches and twigs, more bark ends up in the cooking and pulping process. This necessitates the use of cyclone cleaners to remove bark and other impurities. Since cyclones become more efficient at removing smaller particles as the diameter of the cyclone is decreased, the industry has moved to utilize larger numbers of smaller cyclones, such as cyclones having an inner diameter of 6 inches or less.

However, use of smaller sized cyclones causes problems at the rejects end of the apparatus where the discharge outlet may be only ½ inch or less in diameter. Consequently, there is the great possibility of the narrowing or clogging of the outlet with bark particles, shives, and other impurities. Narrowing or clogging of the discharge outlet has an immediate adverse effect on the separating ability of the cyclone and must be remedied.

Early cyclones had to be partially disassembled to remove the particles plugging the outlet. Naturally, this remedial procedure was time consuming and costly. Later cyclone designs utilized a common manifold connected to the outlet ends of a series of cyclones which had a single, larger diameter orifice located therein, such as the reject control system taught by Rastatter, U.S. Pat. No. 3,543,932. Other cyclone designs, such as the one taught by Jakobsson et al, U.S. Pat. No. 3,696,927, utilized a variable sized rejects outlet opening.

Still other cyclone arrangements made provisions for directing water or compressed air into the rejects outlet to remove blockages. The clustered cyclone apparatus taught by Rastatter, U.S. Pat. No. 3,940,331, made provisions for a series of valves in an outer wall of the apparatus opposite the rejects outlets of the cyclones which could be opened in the event of a blockage.

However, the prior art cyclone devices contained additional elements which made the cyclone structure more complex and which themselves could be subject to operational problems. Accordingly, the need still exists in the art for a simple, inexpensive, and quick mode of removing blockages from the rejects outlet of a cyclone cleaning apparatus.

SUMMARY OF THE INVENTION

In accordance with the present invention, an elastomeric sealing element is provided in the outer wall of the discharge housing of a cyclone cleaning apparatus. The sealing element may be of an elastomeric material such as a silicone rubber which is capable of sealing itself after being pierced. The sealing element is aligned generally opposite the discharge outlet of the cyclone. It may be held in position by a hollow screw pressing the element into a recess in the wall, or may be a grommet-like element having an enlarged head and/or tail portion which spans an aperture in the wall.

In operation, the outer wall of the discharge housing is preferably fabricated of a transparent material such as a polymeric resin to permit viewing of the discharge outlet of the cyclone. The cyclone cleaning apparatus may consist of only a single cyclone or may contain a plurality of cyclones, the discharge housing being sized accordingly. When it appears that the discharge outlet of the cyclone has become blocked, as evidenced by a lack of flow therethrough, the blockage is removed by inserting a sharply-tipped elongated nozzle, attached to a supply of pressurized fluid such as water or air, through the sealing element in the outer wall of the housing and into the discharge outlet. Pressurized fluid is then jetted against the sides of the rejects discharge end of the cyclone to break up and remove accumulated particles of sand, grit, bark, shives, or other material. Once the blockage is removed, the flow of fluid to the nozzle is turned off and the nozzle withdrawn from the discharge housing. The sealing element reseals itself as the nozzle is withdrawn.

Accordingly, it is an object of this invention to provide quick and easy access to the discharge outlet of a cyclone cleaner apparatus; it is a further object of this invention to provide a self-sealing element which can be pierced by a sharply-tipped elongated nozzle. These and other objects and advantages of the invention will become apparent from the following description, the accompanying drawings, and the appended claims,

DESCRIPTION OF THE PREFERRED EMBODIMENTS

Figure 1:
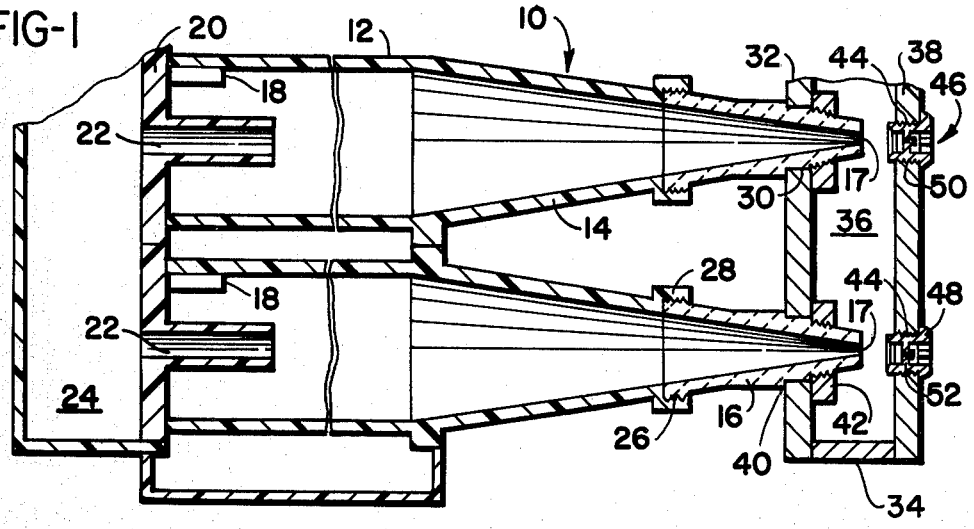
FIG. 1 is a sectional side view of the relative positions of the sealing element in the outer wall of the housing and the discharge outlet of the cyclone cleaning apparatus.

As illustrated in FIG. 1, the cyclone cleaning apparatus includes a hollow cyclone member 10 having a cylindrical portion 12, a frustoconical portion 14, and an apex cone portion 16 which has an outlet port 17. The apparatus may be arranged in a cluster of cyclones as shown and as taught by Rastatter, U.S. Pat. No. 3,940,331. The cylindrical and frustoconical portions of the cyclone body may be formed of a polymeric resin material such as polypropylene, polystyrene, nylon, or the like. The apex cone portion 16 of cyclone member 10 is preferably formed of a ceramic material which resists abrasion. It may be formed by casting in a known manner.

The cylindrical portion 12 of the cyclone has a tangentially extending slot-like inlet 18 through which a fluid suspension of material, such as paper stock, will enter the apparatus. Adjacent the end of cylindrical portion 12 of the cyclone body, a closure cover 20 is provided which may be fabricated of the same polymeric resin material as other portions of cyclone member 10. Closure cover 20 and the end of cylindrical portion 12 may be threaded to provide for sealing engagement. Closure cover 20 is also provided with a centrally located vortex finder or overflow nozzle tube 22 which opens into chamber 24 and extends inwardly into the center of cylindrical portion 12.

Chamber 24 is designed to receive the portion of the fluid suspension having the separated lighter fraction, commonly termed the "accepts". Chamber 24 may be connected to a vacuum source (not shown) which serves to deaerate the stock as it is sprayed from tube 22 into chamber 24. This deaerated stock can then be sent to a receiving apparatus such as the head box of a papermaking machine.

Cyclone member 10 includes an apex cone portion 16 which is preferably formed of an abrasion resistant cast ceramic material. The cone portion 16 forms an extension of frustoconical portion 14, and can be formed with an outwardly projecting threaded portion 26 as an original part thereof for receiving an annular internally threaded coupling nut 28. Alternatively, the threaded portion may be cemented in place on the cone portion 16 in a known manner. Coupling nut 28 serves to seal cone portion 16 to frustoconical portion 14.

The apex cone portion 16 of the cyclone member having outlet port 17 projects into a generally circular opening 30 formed within the flat inner wall 32 of a generally cylindrically shaped housing 34 which defines a discharge chamber 36. The housing 34 includes an outer wall 38 which is in spaced relationship with inner wall 32. As shown in FIG. 1, an annular shoulder 40 is formed on the apex cone portion 16 and abuts inner wall 32 of housing 34. A nut 42 engages threads which can be formed as an integral part of apex cone portion 16 and provides for securing the apex cone portion to the inner wall 32 of the discharge housing 34. Alternatively, the threads may be formed on an annular sleeve made of a plastic material such as nylon and cemented to the apex cone portion 16.

As can be seen in FIG. 1, the apex cone portion 16 of cyclone member 10 terminates in discharge chamber 36 generally opposite threaded opening 44 in outer wall 38. A valve assembly 46 mounted in opening 44 has ribbed portions 48, threaded wall portion 50, and transverse wall portion 52. The ribbed portions 48 enable a tool to engage the valve assembly when inserting it into place or when removing it if replacement is required. The threads on wall portion 50 match those on opening 44 to provide a tight seal when the valve assembly is in place.

Figure 2:
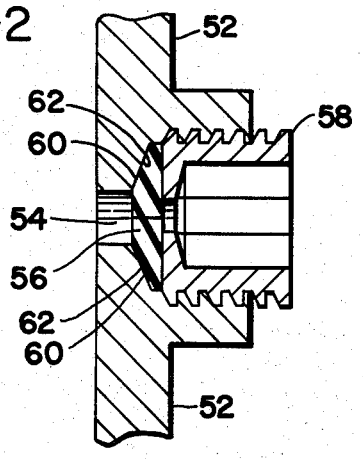
FIG. 2 is an enlarged sectional side view of one type of sealing element used in the practice of this invention.

As best shown in FIG. 2, valve assembly 46 has a transverse wall 52 which extends across the threaded wall portion 50 of the valve and has a small, generally cylindrical passage 54 therethrough. Passage 54 is in general alignment with outlet port 17 of apex cone portion 16 of cyclone member 10. Valve assembly 46 may be fabricated at least in part from a transparent polymeric resin material to enable viewing of the flow of material from the outlet of the apex cone portion 16 of the cyclone. It is to be understood that it is not essential to use a removable valve assembly 46, in that the transverse wall portion 52 can be simply a portion of the housing wall 38 which is counterbored and threaded to receive the screw 58.

Sealing element 56 spans passage 54 and is seated in a counterbored portion of transverse wall portion 52. It is held in position in FIG. 2 by a hollow headed screw element 58. Sealing element 56 may be of any resilient elastomeric material which is capable of resealing itself after being pierced by a sharp implement. By resealing it is meant that the elastomeric material will press against the hole made by the implement and seal it against any leakage of fluid through the element. An example of a material suitable for use is silicone rubber. Room-temperature vulcanizing (RTV) silicone rubber is available in various grades from the General Electric Company, Waterford, N.Y., and under the trademark Silastic from the Dow Corning Corporation, Midland, Mich. As best illustrated in FIG. 2, sealing element 56 may be a unitary disc-shaped element having tapered edges 60 adapted to fit snugly into countersunk recesses 62 in transverse wall portion 52 to seal passage 54.

Figure 3A:
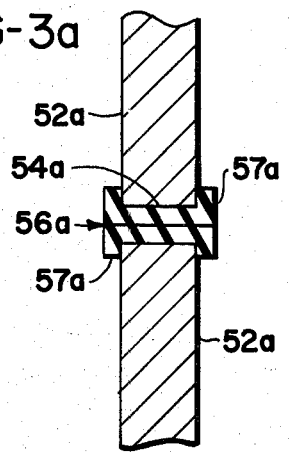
FIGS. 3*a*–3*d* are sectional side views of different sealing element configurations.

Other embodiments of the sealing element are illustrated in FIGS. 3*a*–3*d*. The embodiments of FIGS. 3*a*–3*c* do not require a screw to maintain them in place. In FIG. 3*a*, the sealing element 56*a* is generally cylindrically shaped and has enlarged cylindrically shaped head and tail portions 57*a*. They extend over the edges of transverse wall portion 52*a* to lock the element in place in passage 54*a*. Element 56*a* may be formed in place in passage 54*a* or may be fitted into the passage by compressing head or tail portion 57*a* and sliding the element into passage 54*a*.

Figure 3B:
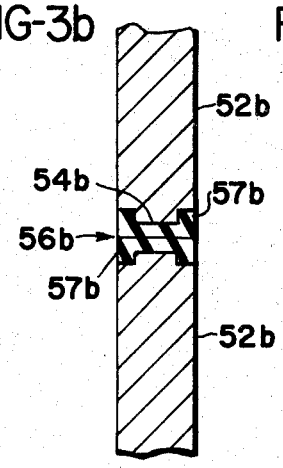

The sealing element illustrated in FIG. 3*b* also comprises a generally cylindrically shaped element 56*b* having enlarged head and tail portions 57*b*. However, in this embodiment, the edges of transverse wall portion 52*b* have counterbored areas into which head and tail portions 57*b* fit. The sealing element can be molded in place in the passage 54*b*.

Figure 3C:
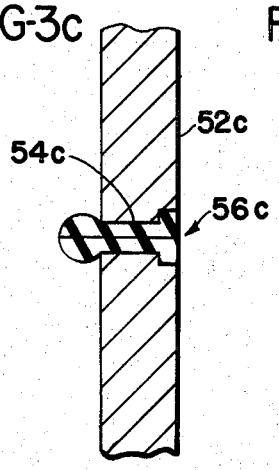

In the embodiment illustrated in FIG. 3*c*, the exterior side of transverse wall portion 52*c* is counterbored, and the head portion of element 56*c* is enlarged to fit into that area. The tail portion of element 56*c* is compressed within passage 54*c*, but expands outwardly beyond the end of the passage to lock the element into place.

Figure 3D:
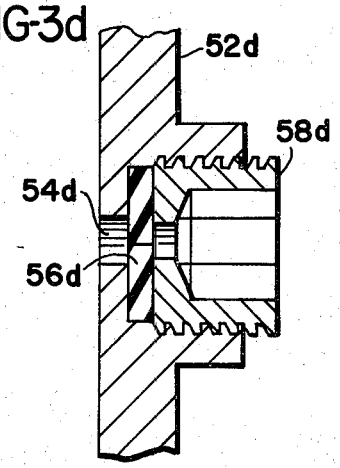

The embodiment illustrated in FIG. 3*d* is a modification of the arrangement illustrated in FIG. 2. In this embodiment, unitary, cylindrically shaped, sealing element 56*d* is positioned in a counterbored recess in transverse wall 52*d* and held in place by hollow screw element 58*d*.

Figure 4:
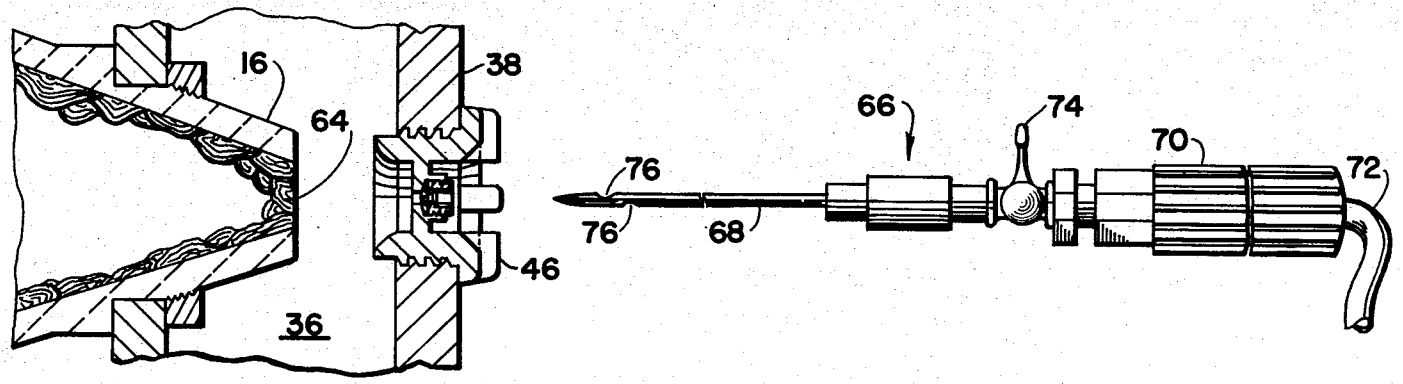
FIG. 4 is a partial section showing the nozzle assembly positioned to pierce the sealing element and break up the blockage in the discharge outlet of the cyclone.
Figure 5:
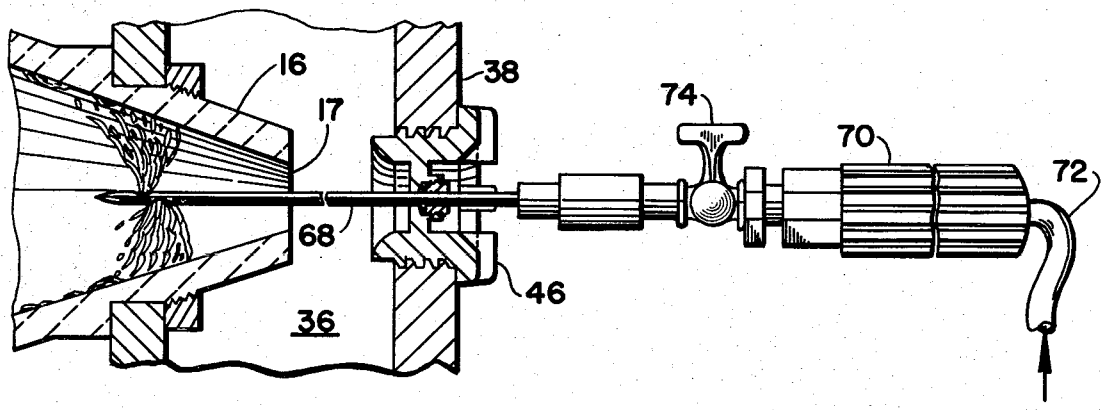
FIG. 5 is a partial section showing fluid being ejected from the sides of the nozzle assembly, removing the blockage in the discharge outlet.

In operation, and as best illustrated in FIGS. 4 and 5, a blockage 64 in the outlet port 17 of apex cone portion 16 of the cyclone can be observed as an absence of fluid flow into discharge chamber 36. The blockage can be removed by inserting a sharply-tipped probe or nozzle assembly 66 into valve assembly 46 and through sealing element 56. The nozzle assembly has a long, needle-like nozzle 68 with a handle 70. It is connected by hose 72 to a source of water or air under pressure.

When the nozzle 68 is in position in the apex cone portion 16, valve 74 is opened and water or air under pressure is expelled from orifices 76 in the tip of the nozzle to break up and remove the blockage. Preferably, at least some of the orifices are located to direct fluid directly against the wall of the apex cone portion 16. Alternatively, in some instances merely inserting the nozzle into the apex cone portion will be sufficient to remove a blockage without the need for use of any fluid under pressure. For such instances, a solid probe will be substantially as effective as a hollow nozzle.

After the blockage has been removed, the nozzle is withdrawn from the cyclone and discharge chamber, and the elastomeric sealing element 56 will reseal itself. This procedure can be repeated whenever a blockage occurs. This construction of the sealing element greatly simplifies the cleaning operation and eliminates the need for manually opening and closing valves or partially disassembling a cyclone cleaning apparatus whenever a blockage occurs.

While the apparatus described herein constitute preferred embodiments of the invention, it is to be understood that the invention is not limited to these precise apparatus, and that changes may be made therein without departing from the scope of the invention, which is defined in the appended claims.

What is claimed is:

1. A cyclone cleaning apparatus for separating a suspension of solid particles into light and heavy fractions, comprising a columnar cyclone member of frustoconical cross section having an inlet end and an apex end, means for introducing said suspension at said inlet end of said cyclone member to produce a high velocity, helical outer vortex of material traveling toward said apex end thereof and an inner vortex of material traveling in the opposite direction, means defining an outlet port for the heavy particle fraction extending axially through said apex end of said cyclone member, housing means defining an outlet chamber enclosing said apex end of said cyclone member to receive said heavy particle fraction directly from said port therein, said housing means including an outer wall having therein an opening generally aligned with said outlet port, and pierceable resilient means sealing said opening and positioned to receive a probe in removable piercing relation therethrough for releasing a blockage in said port.

2. The apparatus of claim 1 wherein said sealing means are formed of silicone rubber.

3. The apparatus of claim 1 wherein said opening in said housing wall is counterbored to provide an annular seat surrounding the inner end of said opening, said sealing means is received on said seat, and said counterbore is internally threaded, and further comprising a screw element threaded in said counterbore in compressing relation with said sealing means, said screw element having an axial passage therethrough aligned with said opening for reception of said probe therethrough.

4. The apparatus of claim 3 wherein said sealing means comprises a generally circular disk-shaped element of substantially the same diameter as said counterbore.

5. The apparatus of claim 3 wherein the inner end of said counterbore is countersunk to provide said seat with a frustoconical configuration, and said sealing means is substantially flat on one side and frustoconical on the other side substantially matching the contour of said seat.

6. The apparatus of claim 1 where said resilient sealing means comprises a generally cylindrically shaped element having a head and tail portion, said head and tail portions having enlarged cross sections which extend radially outwardly from the opposite ends of said opening to lock said sealing means in place within said opening.

7. The apparatus of claim 1 where the ends of said opening have counterbored portions, and said resilient sealing means comprises a generally cylindrically shaped element having a head and tail portion, said head and tail portions having enlarged cross sections which extend radially outwardly into said counterbored portions to lock said sealing means in place in said opening.

8. The apparatus of claim 1 where said axial passage has a counterbored recess facing away from said cyclone member, and said resilient sealing means comprises a generally cylindrically shaped element having a head portion of enlarged cross section adapted to fit in said recess and having a tail portion extending beyond the opposite end of said opening and expanding outwardly to lock said sealing means in place within said opening.

9. The apparatus of claim 1 further comprising a first screw element threadedly engaging said opening in said housing wall and having a transverse internal wall portion provided with a through bore, said screw element being counterbored to provide an annular seat on said wall portion, said sealing means being received on said seat, said counterbore being internally threaded, and a second screw element threaded in said counterbore in compressing relation with said sealing means, said second screw element having an axial passage therethrough aligned with said opening for reception of said probe therethrough.

10. The apparatus of claim 1 in combination with a hollow probe proportioned for releasable piercing engagement with said sealing means, and further comprising means for connecting said hollow probe to a source of fluid under pressure for flushing said port in said cyclone member.

* * * * *